US007118544B2

(12) United States Patent
Murray

(10) Patent No.: US 7,118,544 B2
(45) Date of Patent: Oct. 10, 2006

(54) ORTHOPEDIC BLOCK FOR AND WITH AN ELEVATION DEVICE FOR POSITIONING AN EXTREMITY

(75) Inventor: Scott L. Murray, 1550 Stantake Dr., East Lansing, MI (US) 48823

(73) Assignee: Scott L. Murray, East Lansing, MI (US)

( * ) Notice: Subject to any disclaimer, the term of this patent is extended or adjusted under 35 U.S.C. 154(b) by 0 days.

(21) Appl. No.: 11/040,907

(22) Filed: Jan. 21, 2005

(65) Prior Publication Data

US 2005/0124923 A1 Jun. 9, 2005

Related U.S. Application Data

(63) Continuation-in-part of application No. 10/636,907, filed on Aug. 7, 2003.

(51) Int. Cl.
*A61F 13/00* (2006.01)
*A61F 5/00* (2006.01)
*A47C 20/02* (2006.01)

(52) U.S. Cl. ..... 602/62; 602/23; 602/15; 5/650

(58) Field of Classification Search ..... 602/15, 602/5, 23, 28, 62, 65, 1, 24; 128/845, 882, 128/876, 877, 202.18; 5/648, 624, 621, 661, 5/649–651, 327, 636, 637, 647, 630; 297/423.1; 160/368.2; 24/49, 78; 6/601; 2/5; 15/143
See application file for complete search history.

(56) References Cited

U.S. PATENT DOCUMENTS

| | | | | |
|---|---|---|---|---|
| 830,776 | A | 9/1906 | Flagg | |
| 3,511,233 | A | 5/1970 | Holy, Jr. | |
| 3,843,979 | A | 10/1974 | Treace | |
| 3,857,390 | A * | 12/1974 | Harrison | 602/15 |
| 3,995,846 | A | 12/1976 | Frick | |
| 4,054,204 | A | 10/1977 | Keeton | |
| 4,186,738 | A | 2/1980 | Schleicher et al. | |
| 4,252,306 | A | 2/1981 | Johnson et al. | |
| 4,453,540 | A | 6/1984 | Frain | |
| 4,726,087 | A * | 2/1988 | Schaefer et al. | 5/636 |
| 4,752,064 | A * | 6/1988 | Voss | 5/638 |
| 5,002,046 | A * | 3/1991 | Scott | 602/36 |
| 5,046,487 | A * | 9/1991 | Scott | 601/27 |
| 5,385,534 | A | 1/1995 | Cassford | |
| 5,449,339 | A | 9/1995 | Drennan | |
| 5,537,702 | A * | 7/1996 | Brown-Milants et al. | 5/632 |
| 5,603,692 | A | 2/1997 | Maxwell | |
| 5,613,501 | A * | 3/1997 | Michelson | 5/637 |
| 5,957,874 | A | 9/1999 | Klein | |
| 6,085,371 | A * | 7/2000 | Umhofer | 5/648 |

(Continued)

*Primary Examiner*—Henry Bennett
*Assistant Examiner*—Shumaya B. Ali
(74) *Attorney, Agent, or Firm*—Charles R. Schaub; Emch, Schaffer, Schaub & Porcello, Co

(57) ABSTRACT

An elevation device for resiliently supporting an extremity of a patient that utilizes the packaging for the device to form the finished product. The elevation device includes a support cushion and a planar surface for supporting the support cushion at a desired elevation. At least one guide member is associated with the planar surface for positioning the support cushion on the planar surface. An orthopedic block comprising an upright foot block is removeably positioned on the support cushion and is held in place by buckling opposed ends of a web belt.

22 Claims, 11 Drawing Sheets

U.S. PATENT DOCUMENTS 6,228,044 B1 * 5/2001 Jensen et al. ..... 602/27
6,572,573 B1 6/2003 Klein
6,859,965 B1 * 3/2005 Gourd ..... 5/646

* cited by examiner

ORTHOPEDIC BLOCK FOR AND WITH AN ELEVATION DEVICE FOR POSITIONING AN EXTREMITY

CROSS-REFERENCE TO RELATED APPLICATION

This application is a continuation-in-part of my co-pending U.S. application Ser. No. 10/636,907, Filed Aug. 7, 2003

BACKGROUND OF THE INVENTION

The present invention is generally directed to an orthopedic block that can be used with an elevation device that can be used by a patient to elevate an extremity. In the past, elevation devices have been used to position an extremity on a patient to enhance the healing of an injury or illness suffered by the patient. The elevation devices can also be utilized to protect an injured extremity so that further injury does not occur. It has also been found that positioning the extremity on a resilient surface provides greater comfort to the patient and helps prevent further injuries or complications for the patient. As well as aiding the healing process and the patient's compliance with doctor's instructions. The orthopedic block of the present invention serves to immobilize the foot of a patient when the orthopedic block is used in conjunction with an elevation device of the type described in the aforesaid application Ser. No. 10/636,907, the disclosure of which is incorporated by reference herein.

Accordingly, there is a need in the industry for an elevation device that is smaller in size and that can be packaged in a way that the device can be more readily transported and stored and for an orthopedic block that can immobilize the foot of a patient when the orthopedic block is used in conjunction with an elevation device of the aforesaid character. In addition, there is a need for an elevation device that requires less resilient foam material to properly support an extremity of the patient to reduce the cost of the elevation device product.

SUMMARY OF THE INVENTION

The present invention is directed to an elevation device for positioning an extremity of a patient and foam orthopedic block for use in conjunction with such an elevation device. More particularly, it is an assembleable device that is packaged to require less space when transported and stored and wherein the packaging becomes part of the assembled device. Further, the elevation device of the present invention uses less resilient material than prior elevation devices providing further economic benefits.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT

The present invention is directed to an elevation device that is used for positioning an extremity of an individual. More particularly, the invention is directed to an elevation device that is useful for elevating and supporting the lower portion of a person's leg. The details of the invention will be more readily understood by referring to the attached drawings in connection with the following descriptive material.

Figure 1:
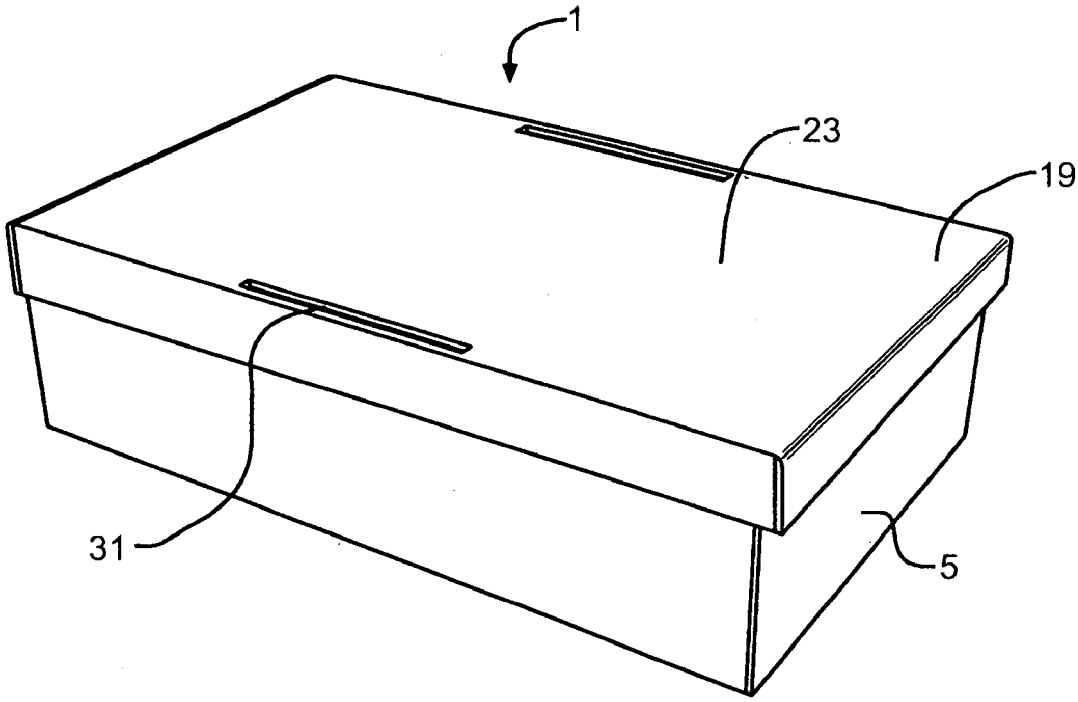
FIG. 1 is a perspective view of the elevation device of the present invention when packaged for shipping and storage.
Figure 2:
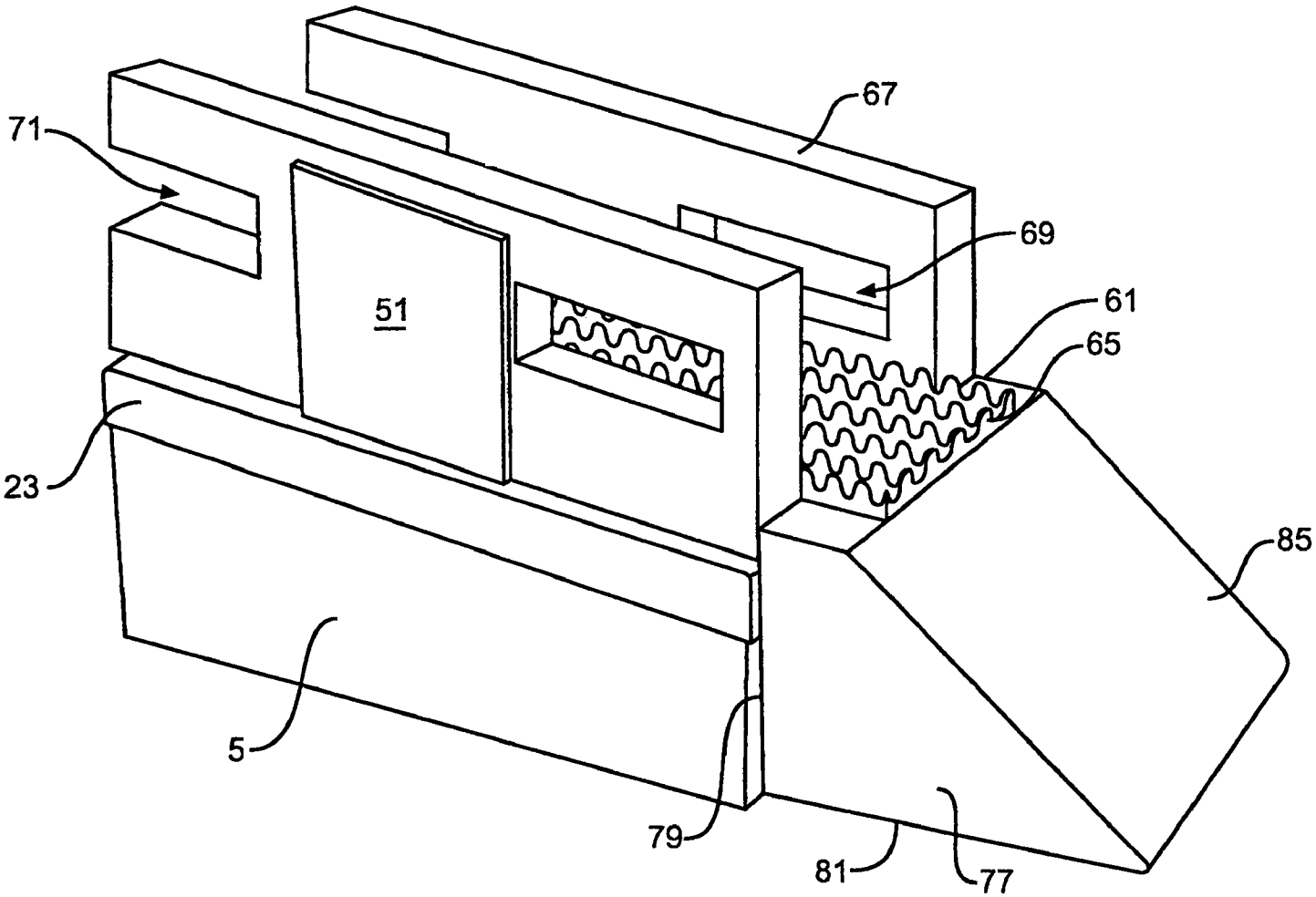
FIG. 2 is a perspective view of the elevation device when configured for use by a patient.

The elevation device of the present invention is shown in the package form whereby it is stored and shipped to the user in FIG. 1 and in the assembled configuration where it is ready to be used by a patient in FIG. 2. A significant advantage of the elevation device 1 is that it is a self contained unit that may be contained within a shipping and storing box 5 where the elevation device takes up less space and is easier to store than prior art devices that have been designed for such a use. The components of the elevation device can then be removed from the box 5 and assembled to form an elevation device that can be used by a patient. The assembled elevation device utilizes the structure of the box 5 to form a portion of the elevation device thereby maximizing the use of the packaging in the elevation device product.

Figure 3:
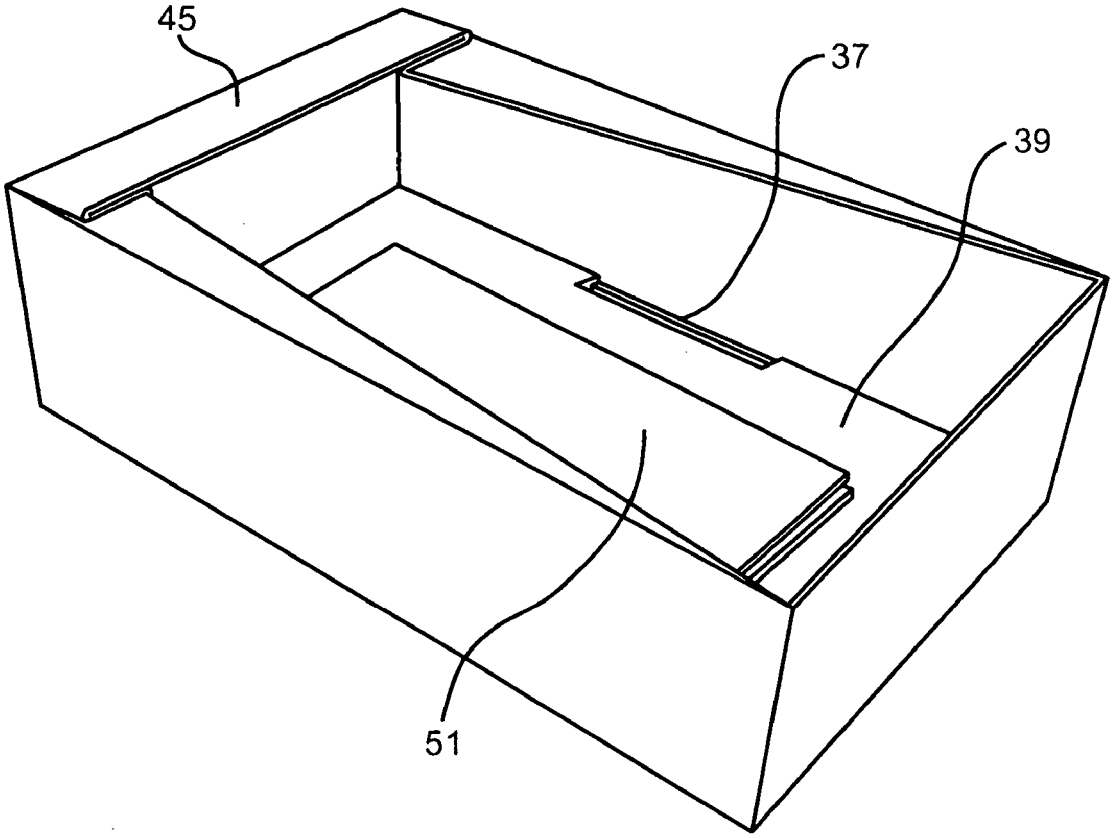
FIG. 3 is a perspective view of the container base used with the present invention.

Referring now to FIGS. 1 and 3, the details of the box 5 will be readily understood. The box 5 has a bottom 9, two opposed end walls 11 and two opposed side walls 13. A lid or top 19 is designed to be positioned on the box 5. The top 19 has a planar surface 23 that is disposed in opposed substantially parallel relationship to the bottom 9 of the box 5 when the lid 19 is positioned on the box 5 as shown in FIG. 1. The lid 19 has two opposed end walls 25 and two opposed side walls 27 that are configured to extend over and be adjacent to the end walls 11 and side walls 13 respectively of the box 5. A pair of slots 31 is positioned in the planar surface 23 of the top 19. The slots 31 are positioned in adjacent spaced apart relationship with the side walls 27 of the top 19. The slots 31 are disposed substantially parallel to the side walls 27.

Figures 4, 5:
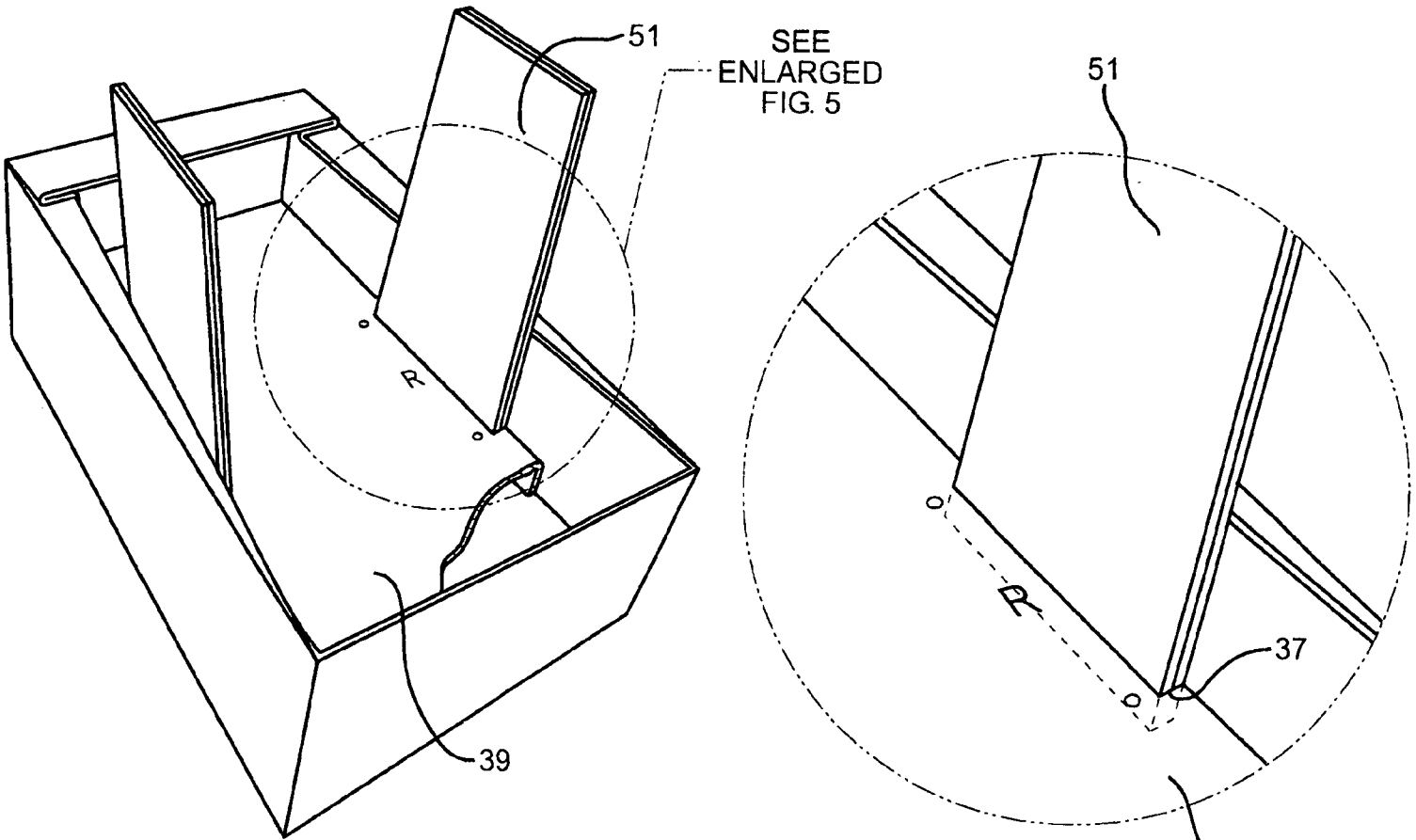
FIG. 4 is a partial perspective view of the container base.
FIG. 5 is a partial perspective view of the container base.

Grooves 37 are positioned in the bottom 9 of the box 5 as shown in FIGS. 3, 4 and 5. The grooves 37 are positioned on opposite sides of the bottom 9 and the grooves 37 are adjacent the opposed side walls 13 of the box 5. The grooves 37 are further disposed to be in alignment with the slots 31 formed in the top 19 that is positioned on the box 5. The grooves 37 do not normally pass through the bottom 9 of the box 5. In fact, it is possible to position an additional layer of material 39 on the bottom 9 of the box 5 and to form the grooves 37 in this additional layer of material 39.

Figure 7:
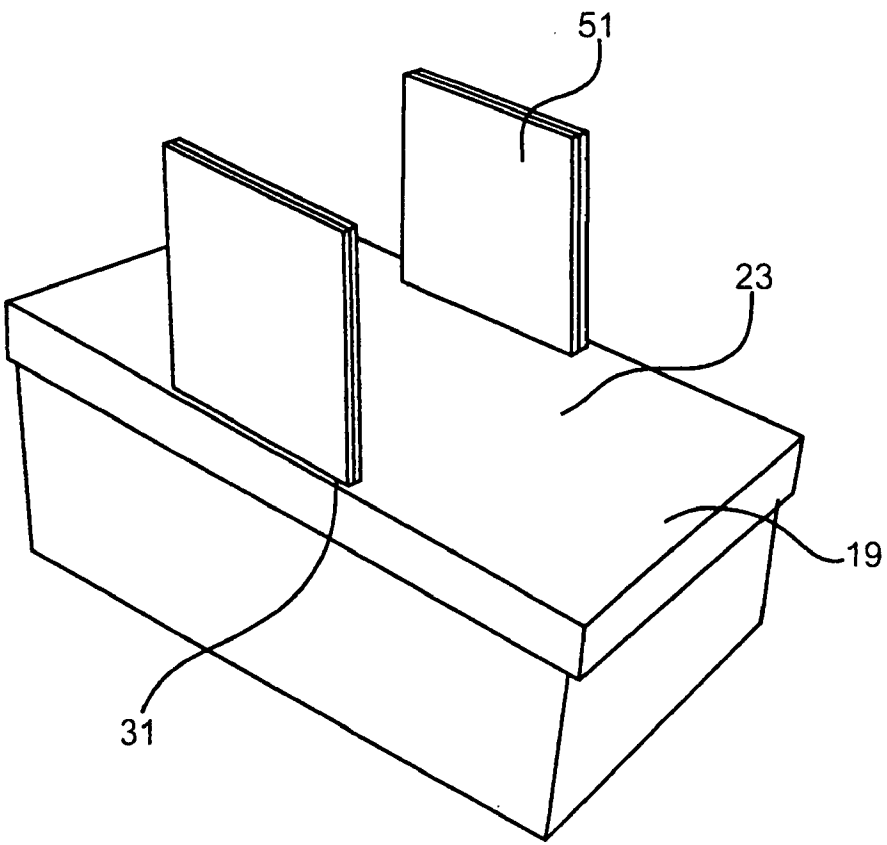
FIG. 7 is a perspective view of the container base in an assembled position.

As shown in FIG. 3, a tab 45 can be positioned on or connected to one end wall 11 of the box 5. An inclined tab 47 can be positioned on or connected to each of the side walls 13 of the box 5. The incline tab 47 is disposed so that the end of the inclined tab 47 that is adjacent the tab 45 on the end wall 11 has the greatest width and the inclined tab decreases in width as the tab extends toward the other end wall 11 of the box 5. Usually, the inclined tab 47 will extend substantially along the length of the side walls 13 and have a substantially constant taper from the end wall 11 where the tab 45 is located as inclined tab 47 moves toward the other end wall 11 of the box 5. The tab 45 and the inclined tabs 47 can be disposed in the folded position as shown in FIG. 3 whereby the top 19 will rest on the end walls 11 and side walls 13 of the box 5 and the planar surface 23 of the top 19 will be substantially parallel to the bottom 9 of the box 5. The tab 45 and the inclined tabs 47 can be extended to the position shown in FIG. 6 and in the extended position the tab 45 will be in alignment with the end wall 11 and the inclined tabs 47 will be in alignment with the side walls 13 of the box 5. When the tab 45 and the inclined tabs 47 are in the extended position, one end of the top 19 will be elevated as shown in FIG. 7. The tab 45 will elevate the end of the top 19 that is adjacent to the end wall 11 where the tab 45 is located. The inclined tabs 47 will engage the interior surface of the planar surface 23 and provide support along the planar surface for support of the top 19 and the inclined position shown in FIG. 7.

Figure 6:
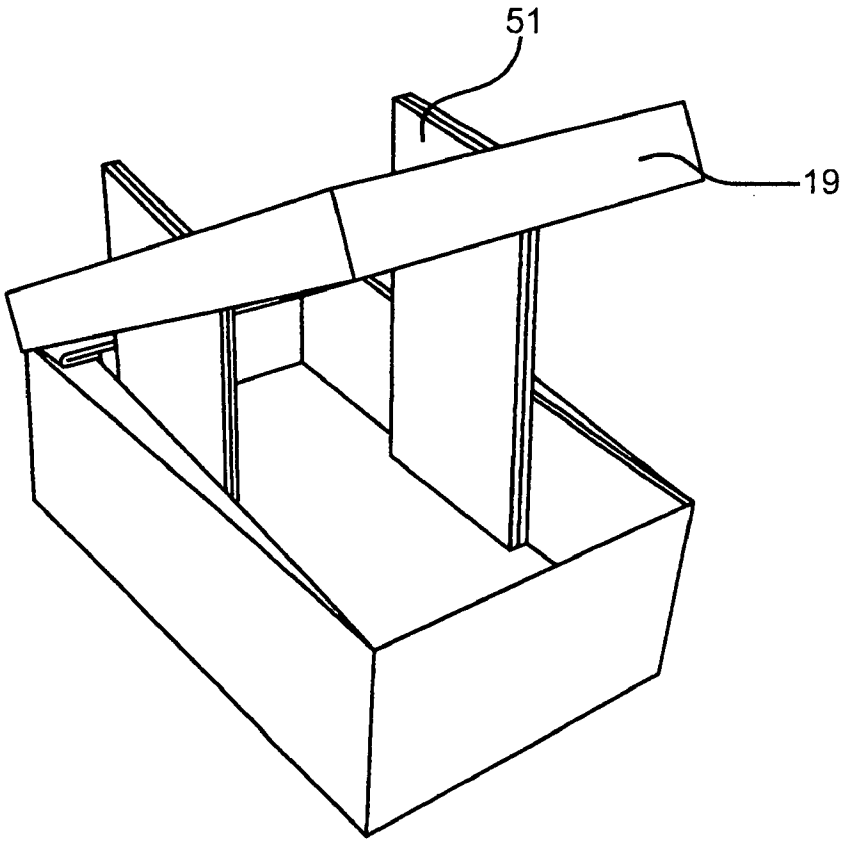
FIG. 6 is a perspective view of the container base in a partially assembled configuration.

As shown in FIGS. 4 and 5 a guide member 51 can be positioned in the grooves 37 positioned in the layer 39 of material on the bottom 9 of the box 5. The guide members 51 are substantially rectangular in configuration and one end of the guide member 51 is disposed to be medianly received in the grooves 37. The guide members 51 extend from the grooves 37 in a direction away from the bottom 9 of the box 5. The guide members 51 are disposed to be adjacent to the side walls 13 of the box 5. The guide members 51 also extend along a portion of the inclined tabs 47 and assist in maintaining the inclined tabs in the extended position as shown in FIG. 4. As shown in FIGS. 2, 6 and 7, the guide members 51 are also disposed to extend through the slots 31 in the planar surface 23 of the top 19. The guide members 51 are designed so that they will extend through the slots 31 in a direction away from the planar surface 23 of the lid 19. As shown in FIG. 3, the guide members 51 can be positioned in the interior of the box 5 when the guide members 51 are not needed to project to through the top 19 positioned on the box 5.

Figure 8:
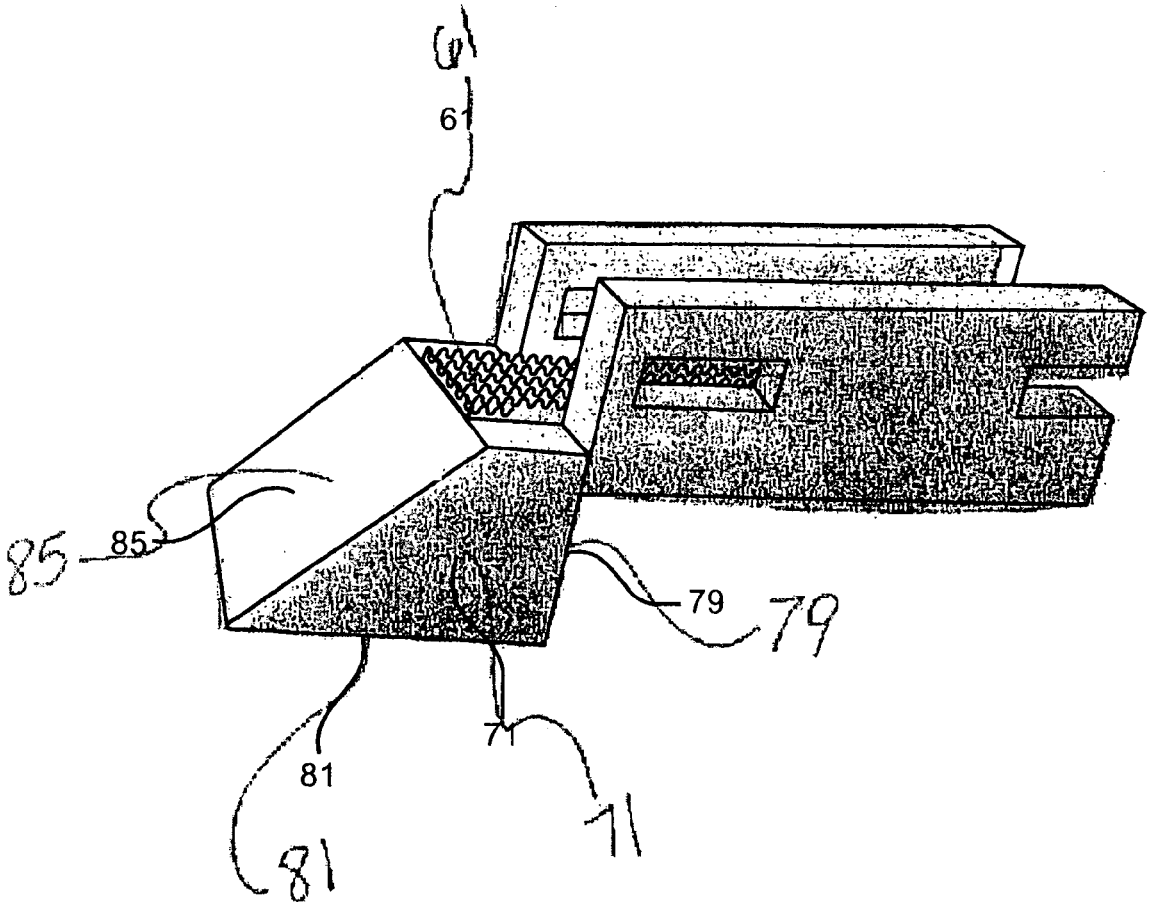
FIG. 8 is a perspective view of the resilient support material in the expanded condition suitable for use with the container base.

FIGS. 2 and 8 shows a support cushion 61 that can be positioned on the planar surface 23 of the top 19 positioned on the box 5 to complete the elevation device 1. The support cushion 61 is formed of a foam material and polyurethane-type foam has been found to be particularly suitable for making the support cushion 61 component of the elevation device 1. The support cushion 61 has a base 63 that is designed to be positioned on the planar surface 23 of the top 19. Side rails 67 extend from the base 63 in a direction away from the planar surface 23 of the lid 19. The side rails 67 are disposed in substantially opposed parallel relationship. Openings 69 can be positioned in opposed relationship in the side rails 67. The openings 69 are usually positioned adjacent one end of the base 63 of the support cushion 61. A notch 71 can be positioned in the side rail 67 of the support cushion 61 at the end of the side rail 67 that is opposite to the end where the opening 69 are located. The notches 71 in the side rail 67 are usually positioned in substantially opposed parallel relationship.

A wedge-shaped support block 77 extends from the base 63 of the support cushion 61. The support block 77 extends from the base 63 in a direction that is opposite to the direction that the side rails 67 extend from the base 63. The support block 77 has a wall 79, a base 81 and an incline surface 85. The wall 79 of the support block 77 is designed to be positioned against the one end wall 11 of the box 5 and one end wall 25 of the top 19. The base 81 of the support block 77 is designed to rest upon the surface that the bottom 9 of the box 5 is supported upon. The incline surface 85 is designed to extend from the support surface for the box 5 to the base 63 of the support cushion 61 as shown in FIG. 2. The guide members 51, as shown in FIG. 2, are designed to extend from the top 19 positioned on the box 5 in a manner whereby they will be positioned adjacent the side rails 67 of the support cushion 61. Plus, the guide members 51 assist in locating the support cushion 61 on the planar surface 23 of the top 19 positioned on the box 5. The guide members 51 provide lateral support for the support cushion 61. The guide members 51 allow the support cushion 61 to have a narrower width without reducing the side-to-side stability of the support cushion that provides patient healing and comfort. Reducing the width of the support cushion reduces the amount of resilient material and thereby reduces the cost of the elevation device.

The portion 65 of the base 63 that extends between the side rails 67 may have an egg crate configuration as shown in FIGS. 2 and 8. It is also possible to utilize the egg crate feature of the foam that defines inclined surface 85. The egg crate configuration helps to reduce pressure points and to improve capillary blood flow through damaged tissues so that the elevation devices in as comfortable as possible for the user.

Figure 9:
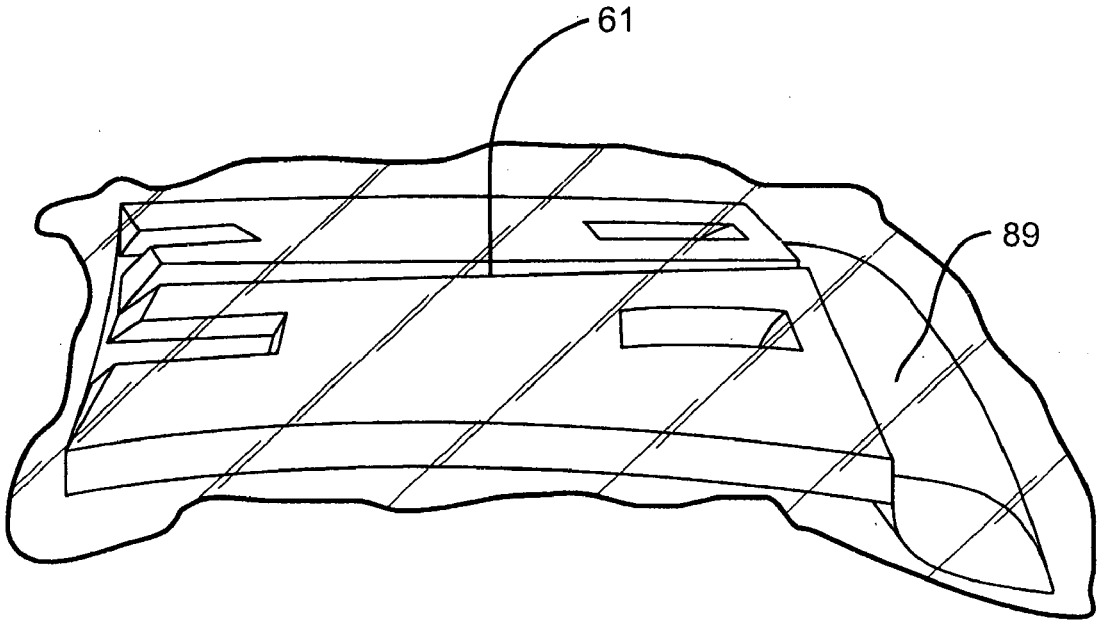
FIG. 9 is a perspective view of the resilient support material in a folded and collapsed position in a container for positioning in the container base during shipment and storage of the elevation device of the present invention.

The support cushion 61 is designed and made a material whereby the support cushion 61 can be folded and compressed for shipping purposes. FIG. 9 shows the support cushion 61 in the folded and compressed position. When the support cushion 61 is in the folded and compressed condition, it can be positioned in a container or package 89 that will maintain the support cushion in the folded and compressed condition. It has been found that a vacuum packed plastic bag type of container 89 works particularly well for maintaining the support cushion 61 in the desired folded and compressed condition. The folded and compressed support cushion 61 as shown in FIG. 9 is designed to have an overall dimension that allows the packaged support cushion 61 to fit into the interior of the box 5 so that the lid 19 can be positioned on the box to secure the packaged support cushion 61 and guide members 51 in the interior of the box 5.

In use, the elevation device is packaged with the packaged support cushion 61 and the guide members 51 positioned in the interior of the box 5 with the top 19 secured to the box 5. This forms a container that is easy to ship, takes up a small space and protects the support cushion 61 from wear and tear until it is time to utilize the elevation device 1 with a patient. The top 19 is removed from the box 5 and the support cushion 61 in the container 89 and the guide members 51 are removed from the box 5 when it is desired to use the elevation device with a patient. The support cushion 61 is then removed from the container 89, unfolded and allowed to expand until it assumes the shape shown in FIG. 8. The guide members 51 are also positioned in the grooves 37 located in the bottom 9 of the box 5 or in the layer of material 39 positioned on the bottom 9. The top 19 is then positioned back on the box 5 in a manner whereby the guide members 51 extend through the slots 31 formed in the top 19. If is desired to place the planar surface 23 of the top 19 at an incline with respect to the bottom 9 of the box 5, the tab 45 associated with end wall 11 and the inclined tabs 47 associated with side walls 13 can be extended as shown in FIG. 6. If it is not desired to place the planar surface 23 at an incline, the tab 45 and inclined tabs 47 can be left in the folded position as shown in FIG. 3 and the planar surface 23 of the top 19 will be substantially parallel to the bottom 9 of the box 5. Once the box 5 and top 19 are assembled in the desired configuration, the support cushion 61 is positioned on the planar surface 23 of the top 19. The base 63 of the support cushion 61 extends along the planar surface 23 and the side rails 67 extend from the base 63 in a direction away from the planar surface 23. The guide members 51 engage the side rails 67 to provide support for the side rails 67. The support block 77 is positioned against an end wall 11 of the box 5 and an end wall 25 of the top 19 as shown in FIG. 2. The base 81 of the support block 77 will then be in position to be supported by the surface upon which the box 5 is located.

Once particularly advantageous use for the elevation device is to support the lower extremity of a person. The person would lay or sit adjacent to the elevation device 1 whereby the upper leg or thigh could be positioned on the incline surface 85 of the support block 77. The knee of the individual would be located approximately where the incline surface 85 joints the base or support surface 63 that is positioned on the planar surface 23 of the top 19. The lower leg or calve region of the lower extremity would extend along the base or support portion 63 of the support cushion 61between the side rails 67. The support surface 63 and side rails 67 provide a cushioned support surface for the lower extremity of the patient. The wedge-shaped support block 77 further provides a cushioned support surface for the thigh or upper portion of the lower extremity of the patient. The size of the various components of the elevation device can be varied in size to accommodate users of various sizes. If desired, a retaining strap can be utilized with the opening 69 or the notches 71 in the side rails 67 of the support cushion 61 to retain the extremity on the elevation device 1. The opening 69 and the notches 71 can also be utilized to provide access for traction pin connections at the patient's knee and/or ankle. Openings can also be positioned in the guide members 51 to provide additional access for traction pin connections. Depending on the needs of the patient, the tab 45 on the end wall 11 and the inclined tabs 47 on the side walls 13 of the box 5 can be extended to provide an incline to the planar surface 23 of the top 19 to produce an inclined, elevated position for the lower extremity.

As is apparent from the above-description, the elevation device 1 of the present invention is packaged in a manner that requires as little space as possible to ship and store the product until it is desired to use the elevation device. In addition, the package for the elevation device provides protection for the resilient cushioning material that is necessary to properly support an extremity. Since the resilient cushioning material is located inside the container for the elevation device, the cushion material is protected from being damaged in a way that would reduce the effectiveness of the cushioning material. Further, the container in which the cushioning material and other components of the elevation device are packaged is used to provide a base for the cushioning material so that less cushioning material is necessary for the end product. This greatly reduces the cost of the material used for the elevation device.

Figure 11:
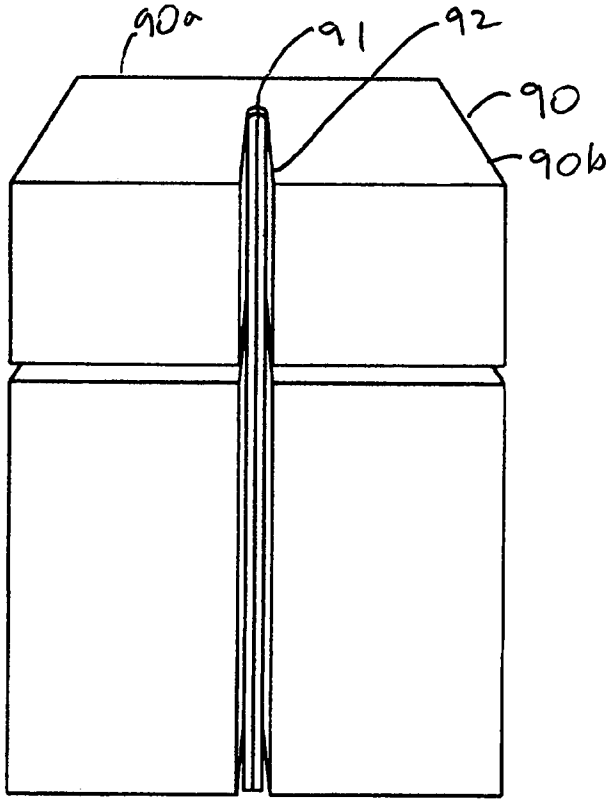
FIG. 11 is a perspective view illustration a subsequent step in the assembly of an orthopedic block of the present invention.
Figure 10:
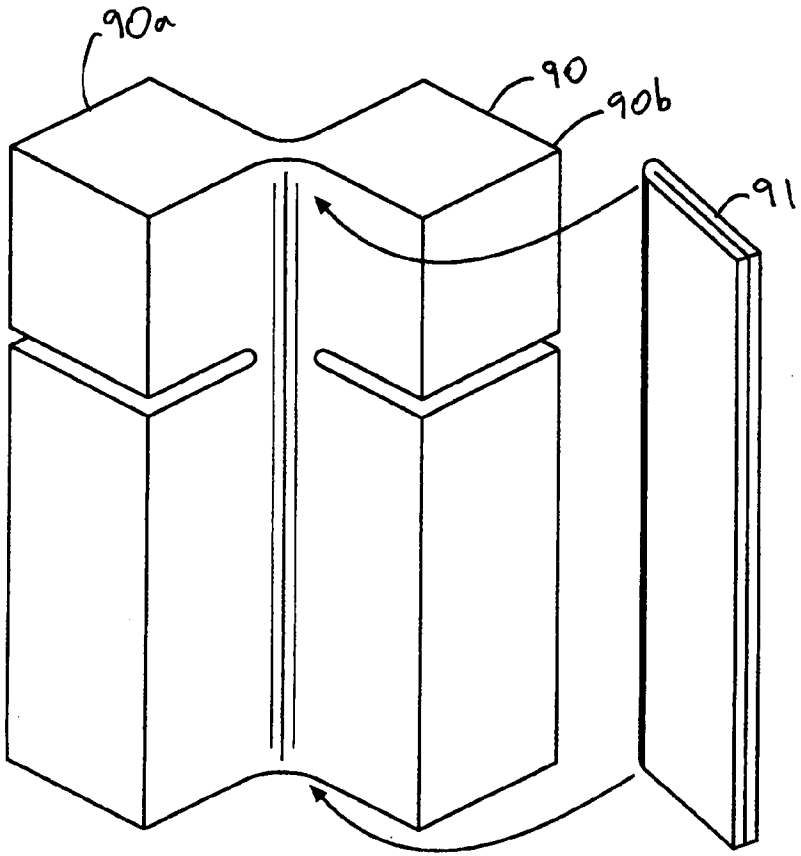
FIG. 10 is a perspective view illustrating a step in the assembly of an orthopedic block of the present invention.
Figure 12:
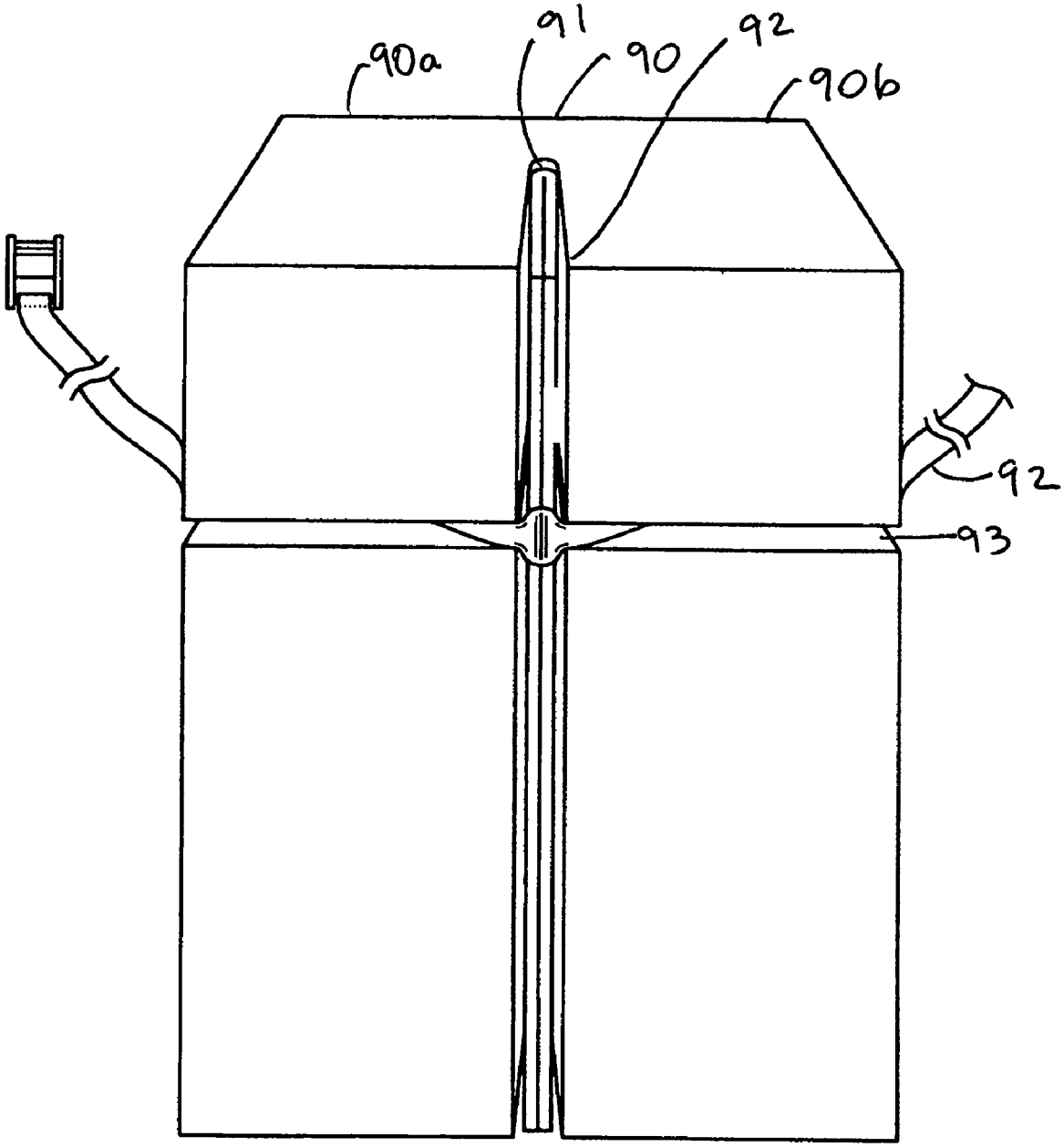
FIG. 12 is a perspective view illustrating a further subsequent step in the assembly of an orthopedic block of the present invention.
Figure 13:
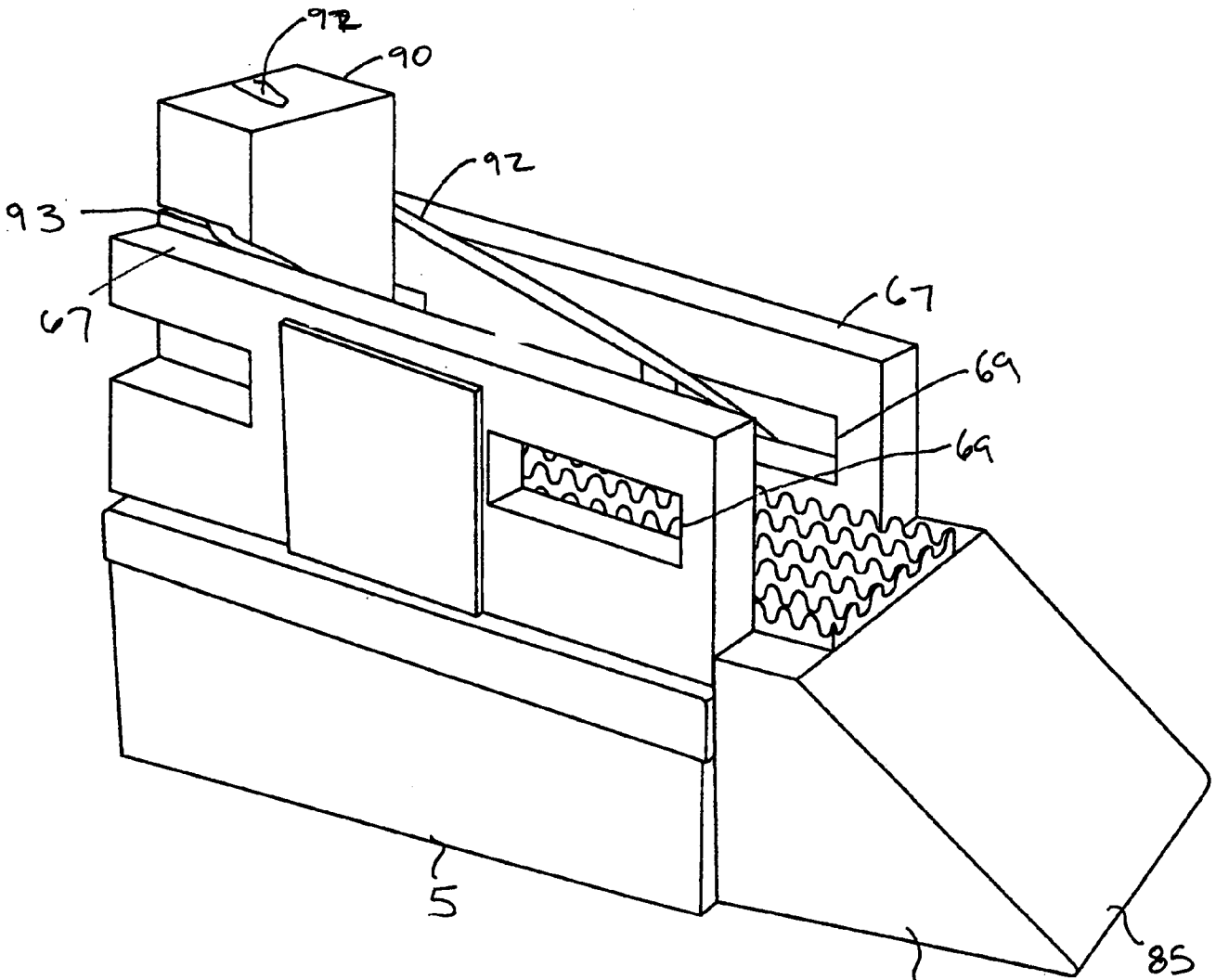
FIG. 13 is a perspective view illustrating an assembly of an orthopedic block of the present invention and an elevation device of the present invention, as show in FIG. 2.
Figure 14:
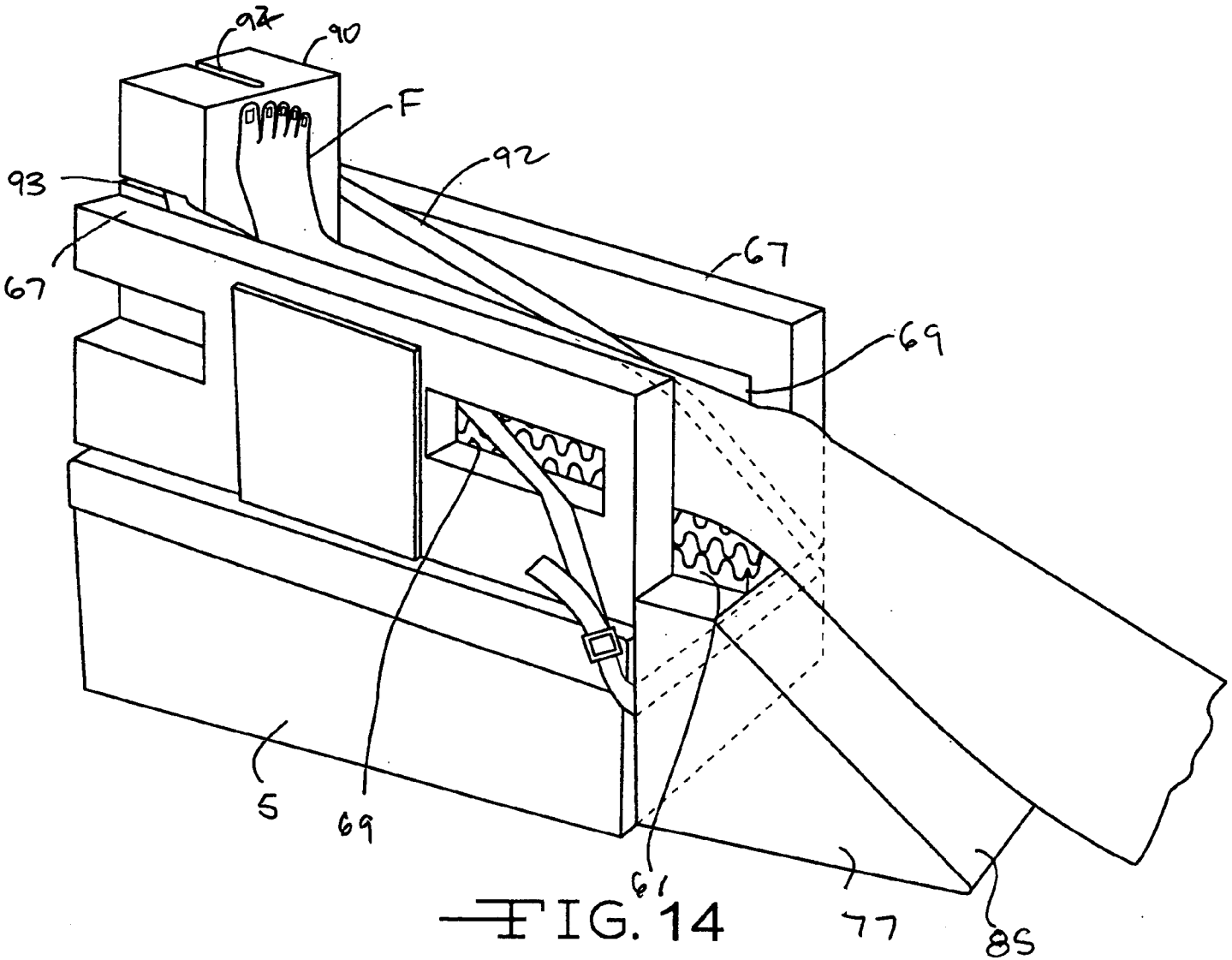
FIG. 14 is a view like FIG. 13 illustrating the assembly of FIG. 13 in use with a foot and leg of a patient.

An orthopedic block according to the present invention is made up of a foot block 90, a stiffener 91 and a web belt 92. The foot block 90 is molded from a flexible polymeric material, for example, expanded polyurethane, and has halves 90*a*, 90*b* that, when folded toward one another from the FIG. 10 position to the FIG. 11 position, are generally rectangular in outline with a vertical slot 92 between the halves 90*a* and 90*b*. The stiffener 91, which is formed of a rigid material, for example, a non-expanded polymeric material, is inserted in the slot 92 of the foot block to prevent the foot block from deforming to an unacceptable extent when a horizontal block is applied against the foot block in use, as show in FIGS. 12 and 13.

The web belt 92 is a double-ended belt a central portion of which is passed through a blind end horizontal slot 93 in the foot block 90. At that level of assembly, the foot block 90, with the stiffener 91 in place, is positioned in an upright orientation on an upper surface of the support cushion 61 between the side rails 67. The width of the foot block 90 is such that it fits snugly between the side rails 67 to avoid undue mobility of a foot F that engages its front surface, as show in Fig. A. Front to back movement of the foot block 90 in use is prevented by buckling together opposed ends of the web belt 92 at a location in engagement with a front end of the box 5, between the box 5 and the support block 77, the opposed positions of the web belt 92 leading to its opposed ends passing through the openings 69.

When not in use, the elements of the orthopedic block can be stored in the box 5 along with the elements of the elevation device 1. The elements of orthopedic block are designed such that they can be collapsed with the leg elevation device 61 and vacuum packed in a container 89 for storage and shipping. The foot block 90 can alternatively be collapsed and vacuum packed in a separate container. The design of the foot block 90 allows that, when collapsed and vacuum packed, either with the leg elevation device 61 in container 89 or separately, it fits into Box 5.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. An assembly comprising elevation device for positioning an extremity, the elevation device comprising:

a support cushion for resiliently supporting the extremity;

a planar surface for supporting a support cushion at a desired elevation, the planar surface being the top of a box and the height of the box positions the support cushion at the desired elevation;

at least one slot disposed in the top;

at least one guide member operatively connected to the planar surface; the at least one guide member positioned in the at least one slot for securing the guide member on the top and for positioning the support cushion on the planar surface; and an orthopedic device removeably positioned on the support cushion for immobilizing a portion of the extremity that is supported on the support cushion.

2. The assembly of claim 1 wherein the box has sidewalls that support the top.

3. The assembly of claim 2 wherein the box includes a foldable tab that can be positioned to elevate one end of the top wherein the top is positioned on an incline and positions the support cushion on an incline.

4. The assembly of claim 3 wherein the fordable tab is positioned on each sidewall of the box for elevating one end of the top.

5. The assembly of claim 4 wherein the foldable tabs define an inclined surface that extends from the sidewalls of the box.

6. The assembly of claim 1 wherein the guide member extends through the slots and into the interior of the box to properly secure and locate the guide member with respect to the top.

7. The assembly of claim 6 wherein a slot is positioned on opposed sides the top adjacent the sidewalls of the box and a guide member is positioned in each slot so that a portion of the guide member extends form the surface of the top that supports the support cushion whereby the guide members positioned the support cushion on the top.

8. The assembly of claim 1 wherein the support cushion is a resilient material that cushions the extremity supported on the elevation device.

9. The assembly of claim 8 wherein the support cushion includes at least one side that extends from the support cushion along the at least one guide member.

10. The assembly of claim 8 wherein the support cushion includes an angled support portion that extends from the support cushion and along one end wall of the planar surface, the support portion being disposed to support an additional part of the extremity.

11. The assembly of claim 9 wherein the at least one side of the support cushion includes an opening for positioning the extremity on the device.

12. The assembly of claim 11 wherein the opening is disposed to allow traction devices to be attached to the extremity.

13. The assembly of claim 9 wherein the portion of the support cushion that is in contact with the extremity has an egg crate configuration.

14. The assembly of claim 2 wherein the support cushion can be positioned in the box for shipping and storage.

15. The assembly of claim 14 wherein the support cushion can be placed in a vacuum packed container to reduce the size of the support cushion.

16. The assembly of claim 1 wherein the orthopedic device comprises:

an upright, flexible member adapted to be positioned on the support cushion, the flexible member having a front face and a rear face, the rear face having a vertical slot and a horizontal slot;

a rigid stiffener removeably placed in the vertical slot; and a double-ended web belt having a central portion placed in the horizontal slot, opposed ends of the web belt being adapted to be connected to accurately longitudinally position the upright flexible member on the elevation device.

17. The assembly of claim 16 wherein the cushion of the elevation device has an opposed pair of spaced-apart, upstanding side rails that extend parallel to one another, and wherein the upright flexible member is adapted to be accurately laterally positioned between the side rails.

18. An orthopedic block for use with an elevation device for positioning an extremity, the orthopedic block comprising:

an upright flexible member adaptable to be positioned on the elevation device, the flexible member having a front face that is disposed for engaging the extremity and a rear face that is in spaced apart relationship with the extremity, the rear face having a vertical slot and a horizontal slot;

a rigid stiffener adapted to be removeably placed in the vertical slot the rigid stiffener being disposed in the vertical slot in spaced apart relationship with the extremity; and a double-ended web belt adapted to have a central portion placed in the horizontal slot, opposed ends of the web belt being adapted to be connected to accurately longitudinally position the upright flexible member on the elevation device.

19. The assembly of claim 16 wherein the planar surface is the top of a box and the height of the box positions the support cushion at the desired elevation.

20. The assembly of claim 19 wherein the support cushion and the orthopedic device can be positioned in the box for shipping and storage.

21. The assembly of claim 20 wherein the support cushion and the orthopedic device can be placed in a vacuum packed container to reduce the size of the support cushion and orthopedic device.

22. The assembly of claim 20 wherein the support cushion can be placed in a vacuum packed container to reduce the size of the support cushion and the orthopedic device can be placed in a vacuum packed container to reduce the size of the orthopedic device.

* * * * *